US011426741B2

(12) United States Patent
Wu et al.

(10) Patent No.: US 11,426,741 B2
(45) Date of Patent: Aug. 30, 2022

(54) WATER OUTPUT DEVICE

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Ching-Yin Wu, Taichung (TW); Che-Min Lin, Taichung (TW)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 88 days.

(21) Appl. No.: 17/079,066

(22) Filed: Oct. 23, 2020

(65) Prior Publication Data

US 2022/0126309 A1 Apr. 28, 2022

(51) Int. Cl.

| | |
|---|---|
| ***B05B 1/16*** | (2006.01) |
| ***B05B 1/04*** | (2006.01) |
| ***B05B 1/18*** | (2006.01) |

(52) U.S. Cl.

CPC ..... *B05B 1/1636* (2013.01); *B05B 1/044* (2013.01); *B05B 1/185* (2013.01)

(58) Field of Classification Search

CPC ..... B05B 1/044; B05B 1/16; B05B 1/1627; B05B 1/1636; B05B 1/18; B05B 1/185

See application file for complete search history.

(56) References Cited

U.S. PATENT DOCUMENTS

| | | | | |
|---|---|---|---|---|
| 8,490,894 | B2 * | 7/2013 | Lu | B05B 15/654 239/394 |
| 8,708,255 | B2 * | 4/2014 | Steffens | B05B 1/18 239/443 |
| 9,132,437 | B2 * | 9/2015 | Zhou | B05B 1/1645 |

(Continued)

FOREIGN PATENT DOCUMENTS

| | | | | |
|---|---|---|---|---|
| CN | 107115984 | A * | 9/2017 | B05B 1/12 |
| EP | 2092984 | A1 * | 8/2009 | B05B 1/1654 |
| WO | WO-2011063726 | A1 * | 6/2011 | B05B 1/1645 |

*Primary Examiner* — Darren W Gorman

(74) *Attorney, Agent, or Firm* — Birch, Stewart, Kolasch & Birch, LLP

(57) ABSTRACT

A shower apparatus includes a pivotable member and a main body having a receiving space, an inlet communicating with the receiving space, and a first outlet. A first communicating hole is located at a connection site between the receiving space and the inlet in the main body. The pivotable member is pivotally connected to the main body and is manipulated to pivot relative to the main body and includes a pivotal axle disposed in the receiving space and a second outlet. When the pivotable member is pivoted relative to the main body, the pivotal axle is simultaneously pivoted in the same direction in the receiving space. The pivotal axle has a tube body, an isolating member, a second communicating hole, and a third communicating hole. The isolating member is fixed in the tube body to divide an inner space of the tube body separately into a first flow channel and a second flow channel. When the first communicating hole communicates with either the second communicating hole or the third communicating hole, water flows through one of the first flow channel or the second flow channel, thereby the water is outputted through one of the first outlet and the second outlet.

14 Claims, 19 Drawing Sheets

(56) References Cited

U.S. PATENT DOCUMENTS

2013/0126645 A1* 5/2013 Zhou ..... E03C 1/0404
239/581.1
2018/0257097 A1* 9/2018 Blessing ..... B05B 1/3006

* cited by examiner

WATER OUTPUT DEVICE

BACKGROUND OF THE INVENTION

Technical Field

The present invention relates generally to a shower apparatus, and more particularly to a shower apparatus which could be adjusted by turning over or folding depending on the required demand.

Description of Related Art

In the modern society, cleaning body is a daily routine, wherein most of people cleaning their body mainly by taking a shower.

Generally, a conventional shower fixture merely includes either a shower head or a spray head, so that the user could only take a shower by using the shower head or the spray head, resulting in lack of fun of various spray efficacies. Thus, the conventional shower fixture has room for improvement to increase a variety of the shower fixture, thereby increasing fun during showering and satisfying a required demand of the user.

BRIEF SUMMARY OF THE INVENTION

In view of the above, the primary objective of the present invention is to provide a shower apparatus which could provide multiple output functions by pivoting on the required demand of the user, thereby increasing fun during showering and satisfying a required demand of the user.

The present invention provides a shower apparatus includes a main body and a pivotable member. The main body has a receiving space, an inlet, and at least one first outlet, wherein the receiving space communicates with the inlet, and the main body has a first communicating hole located at a connection site between the receiving space and the inlet. The pivotable member pivotally connected to the main body and adapted to be operated to pivot relative to the main body, wherein the pivotable member includes a pivotal axle and at least one second outlet, wherein the pivotal axle is disposed in the receiving space. When the pivotable member is manipulated to pivot relative to the main body, the pivotal axle is simultaneously pivoted in the same direction in the receiving space. The pivotal axle has a tube body, an isolating member, a second communicating hole, and a third communicating hole, wherein the isolating member is fixed in the tube body to divide an inner space of the tube body to separately form a first flow channel and a second flow channel. The second communicating hole communicates with the at least one first outlet via the first flow channel. The third communicating hole communicates with the at least one second outlet via the second flow channel. When the pivotable member is manipulated to pivot relative to the main body to make the second communicating hole of the pivotal axle communicate with the first communicating hole of the main body, a stream flowing through the first flow channel is outputted through the at least one first outlet. When the pivotable member is manipulated to pivot relative to the main body to make the third communicating hole of the pivotal axle communicate with the first communicating hole of the main body, a stream flowing through the third communicating hole and the second flow channel is outputted through the at least one second outlet With the aforementioned design, the user could manipulate the pivotable member to change the pivotal position and to allow either the second communicating hole or the third communicating hole of the pivotal axle to communicate with the first communicating hole of the main body, so that water could flow through either the first flow channel or the second flow channel to be outputted through corresponding one of the first outlet and the second outlet, thereby providing various output functions to increase fun during showering and to satisfy the required demand of the user.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
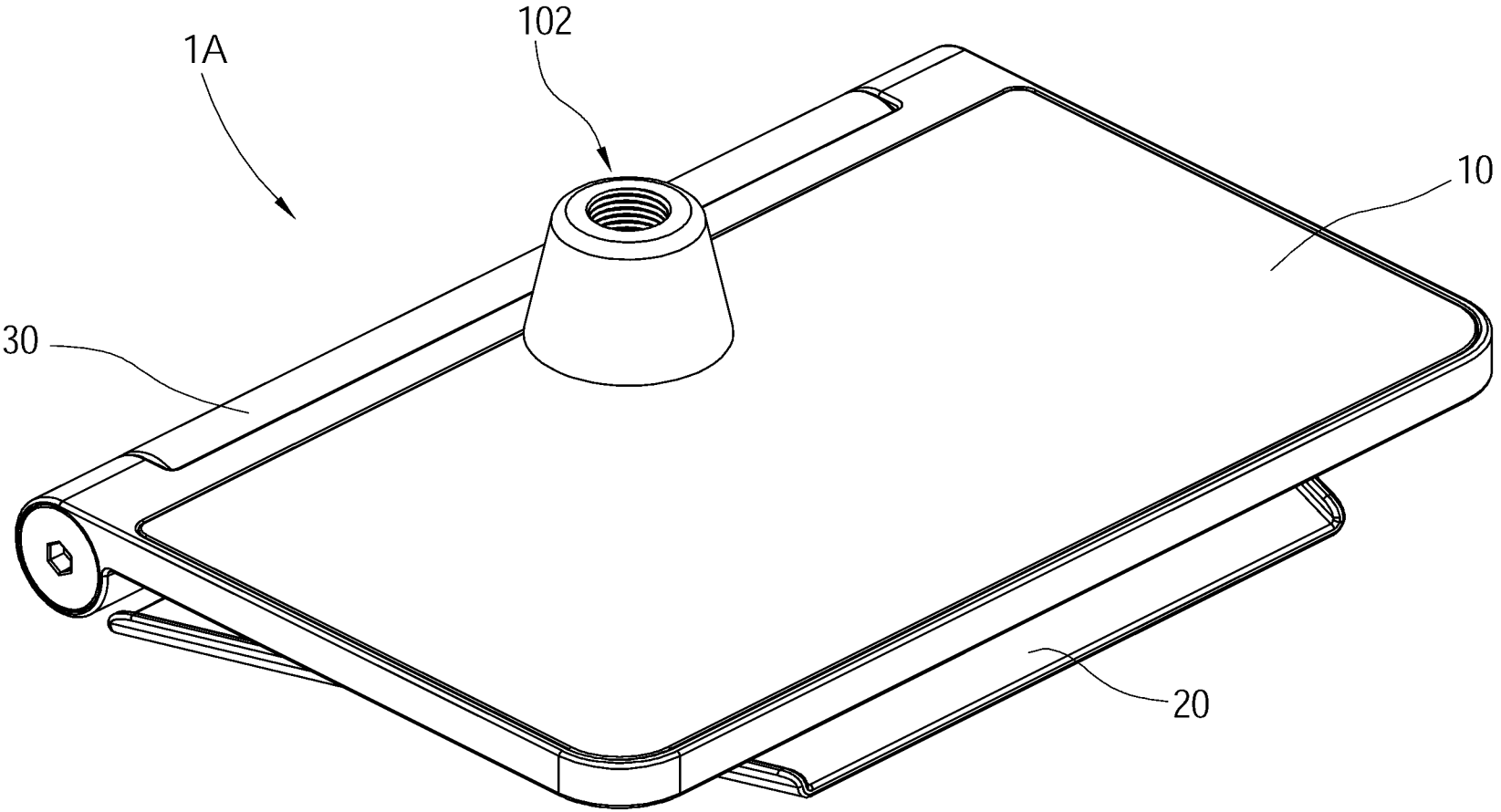
FIG. 1 is a perspective view of the shower apparatus of a first embodiment according to the present invention.
Figure 2:
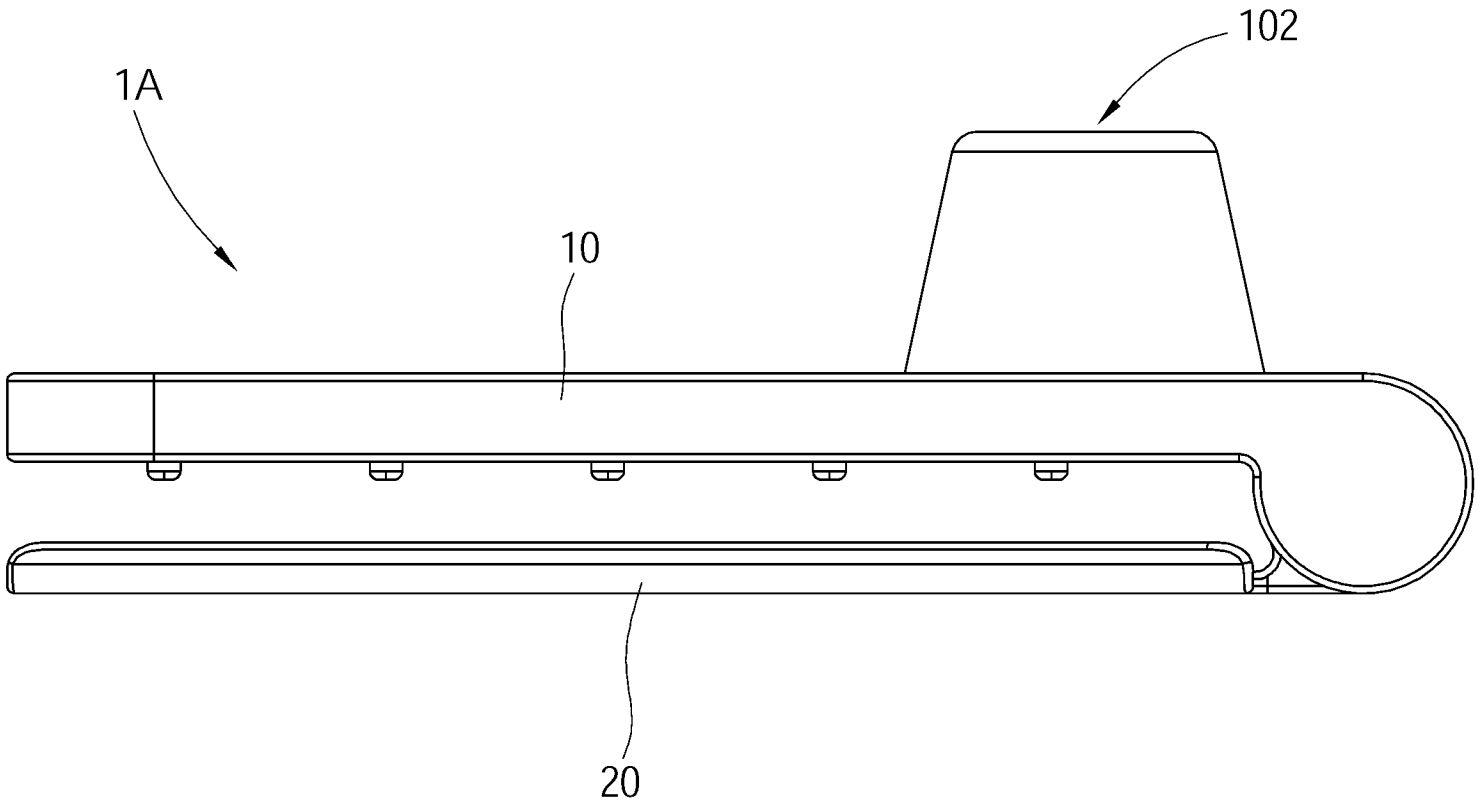
FIG. 2 is a side view of the shower apparatus shown in FIG. 1, wherein the shower apparatus is in the shut-off state.
Figure 3:
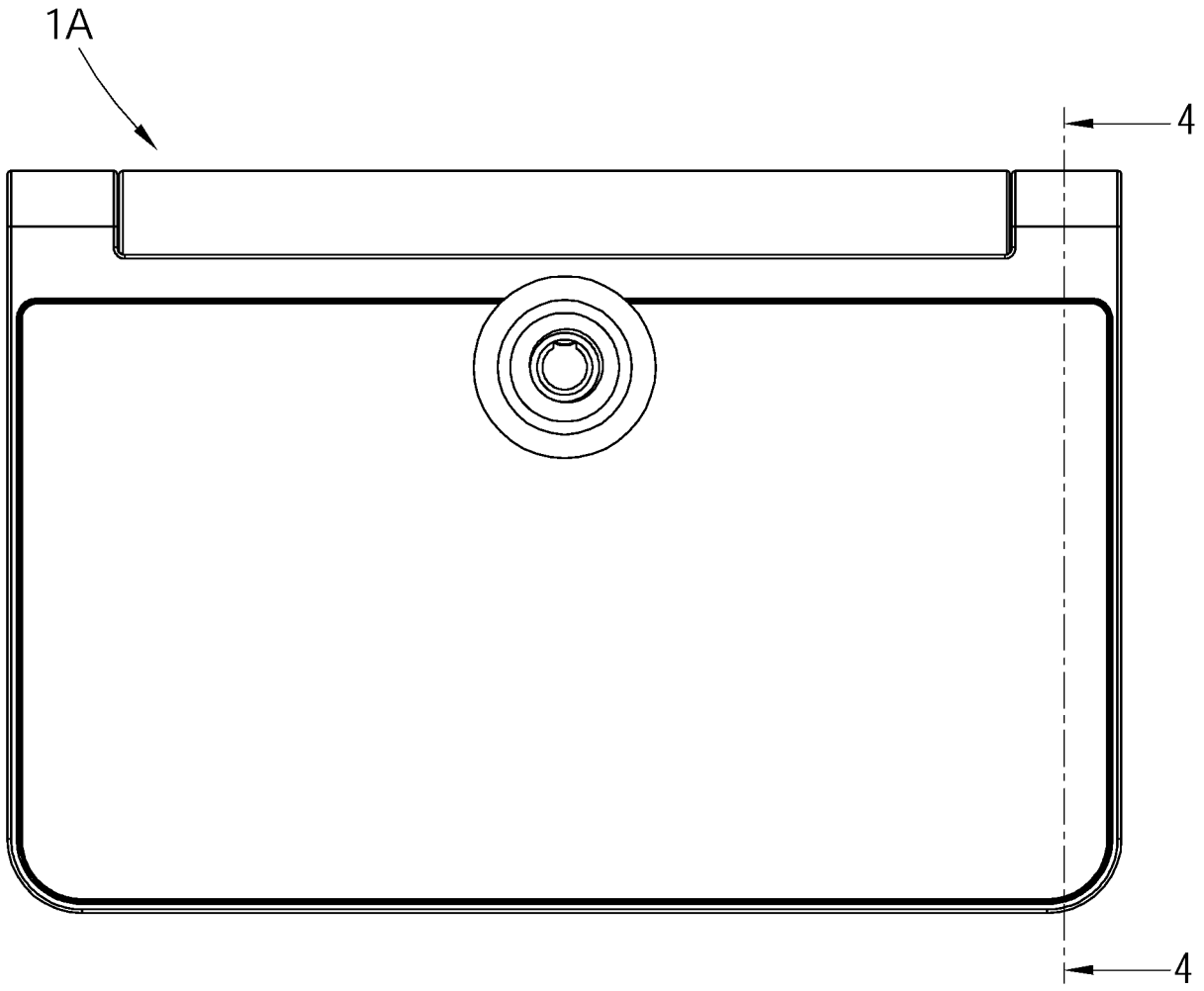
FIG. 3 is a top view of the shower apparatus shown in FIG. 1.
Figure 4:
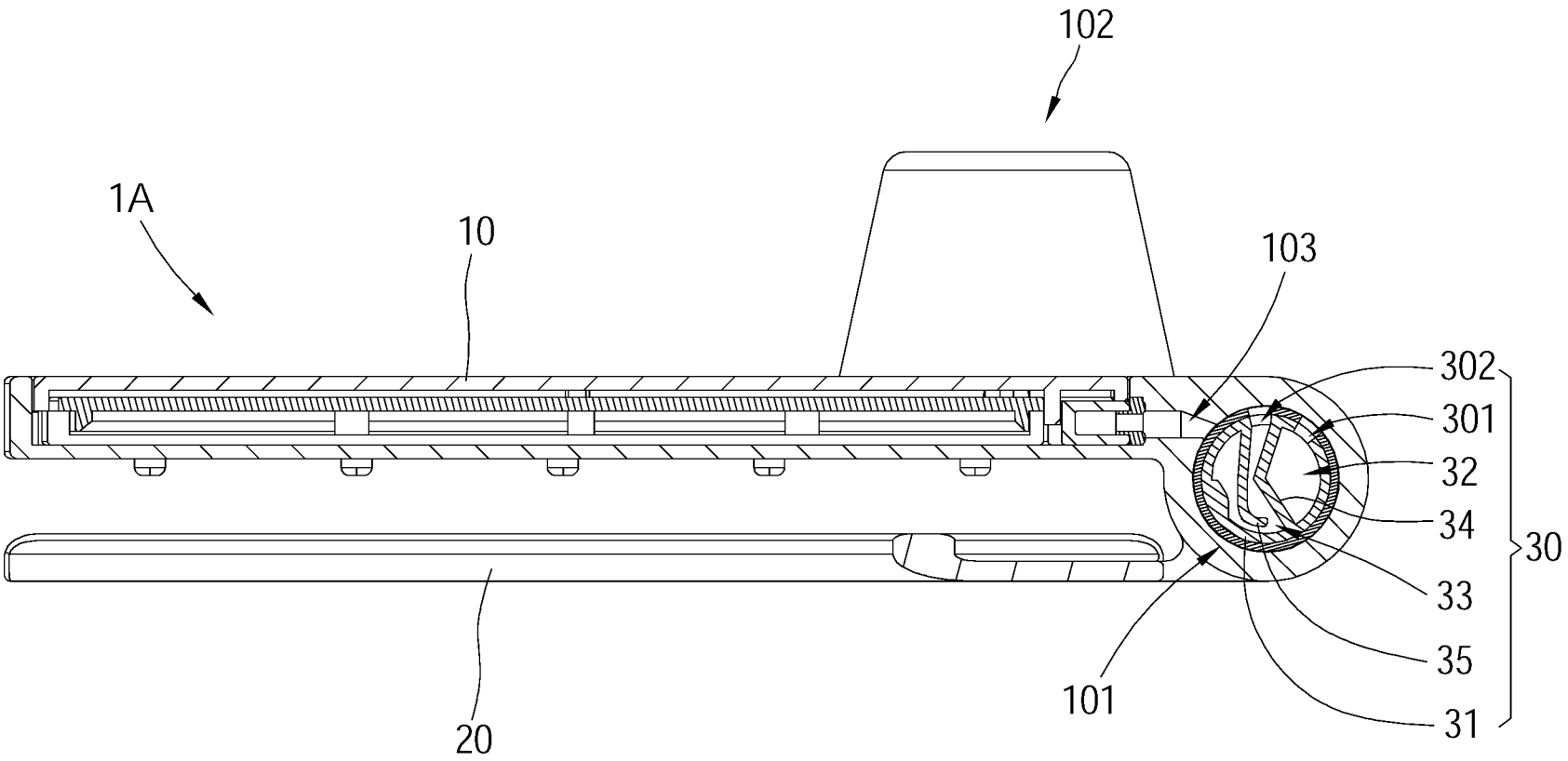
FIG. 4 is a sectional view taken along the 4-4 line in FIG. 3, wherein the shower apparatus is in the shut-off state.
Figure 5:
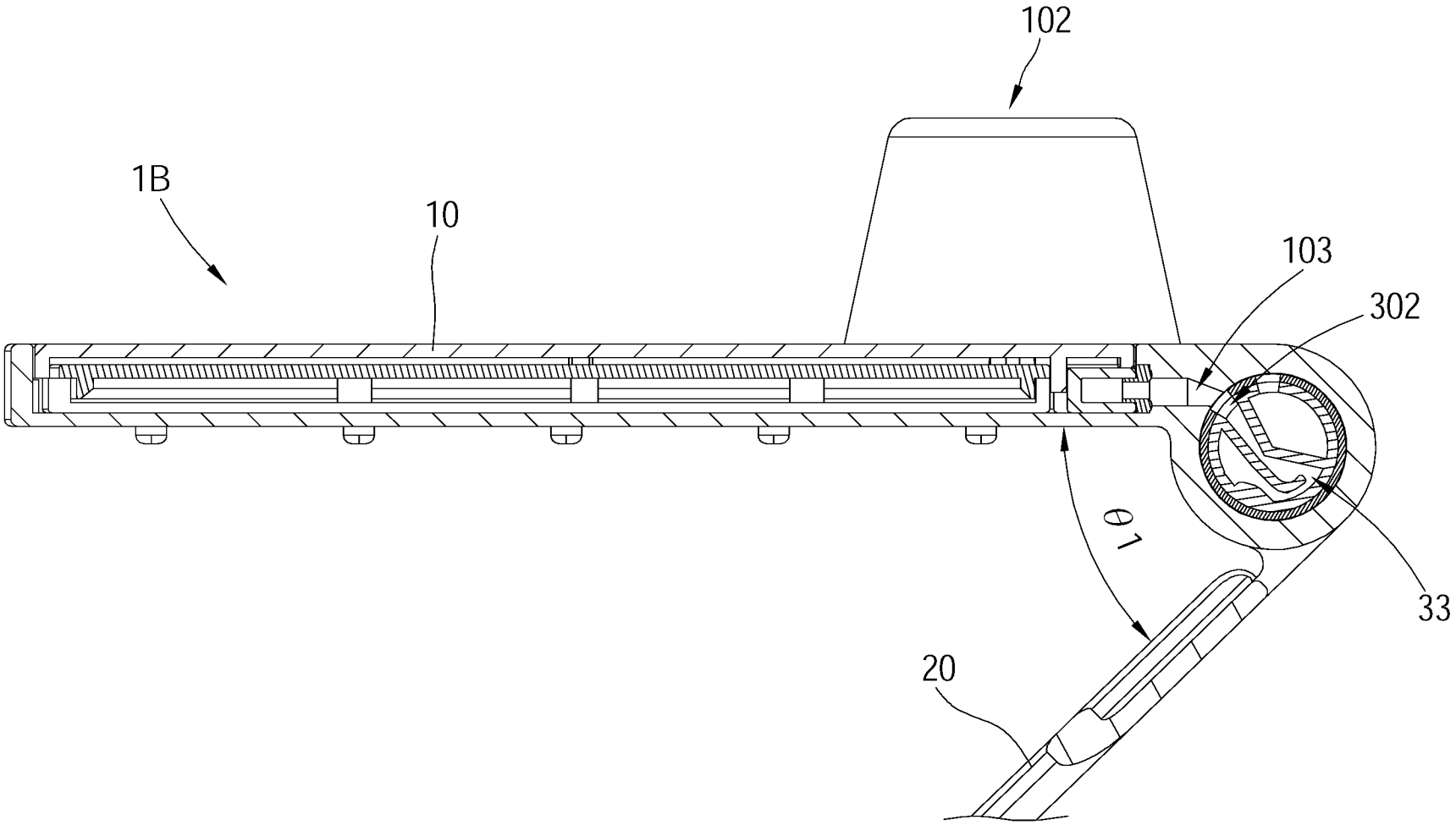
FIG. 5 is similar to FIG. 4, showing a sectional view of the shower apparatus of the first embodiment according to the present invention, wherein the shower apparatus is in the first output state.
Figure 6:
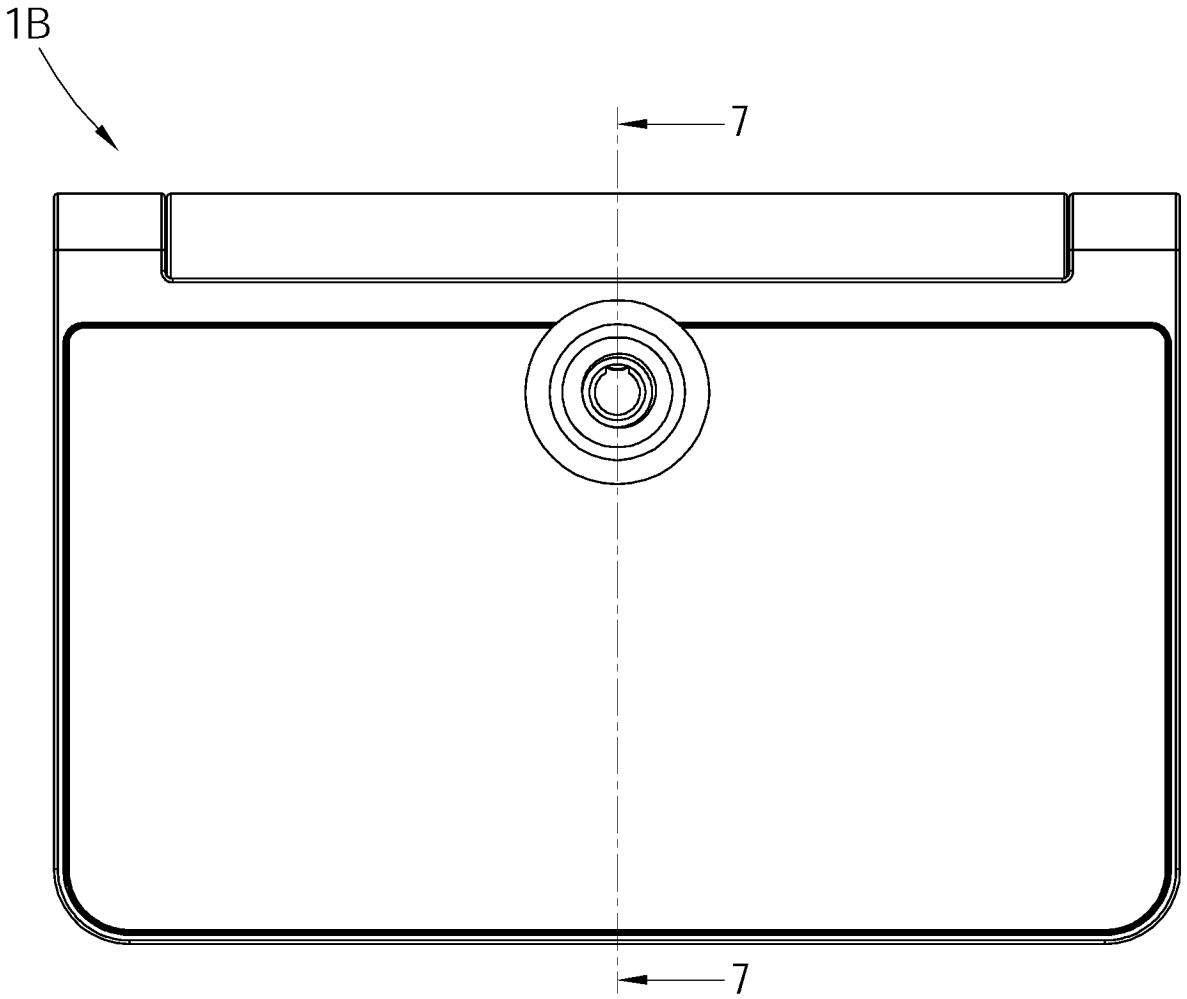
FIG. 6 is a top view of the shower apparatus of the first embodiment according to the present invention, wherein the shower apparatus is in the first output state.
Figure 7:
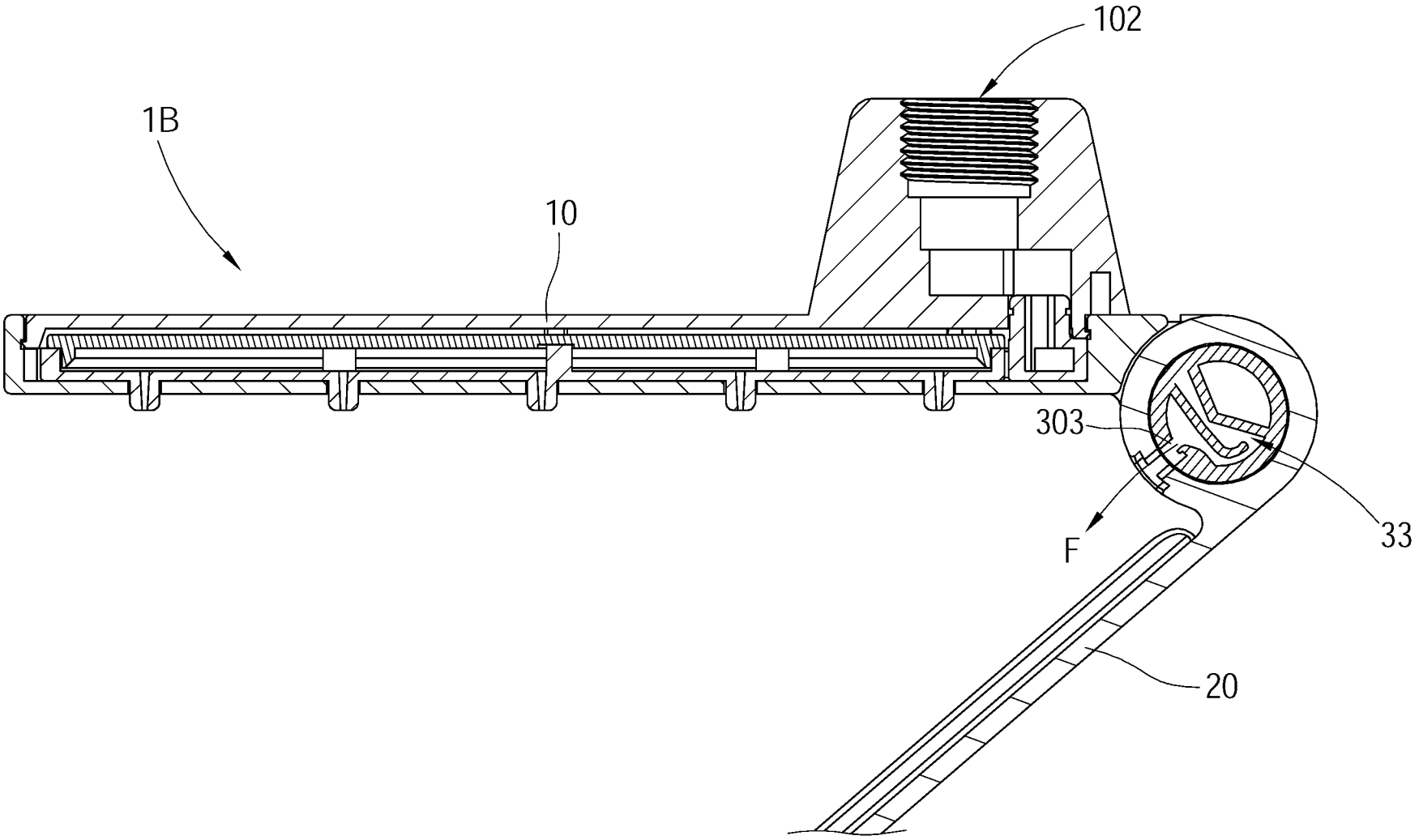
FIG. 7 is a sectional view taken along the 7-7 line in FIG. 6.
Figure 8:
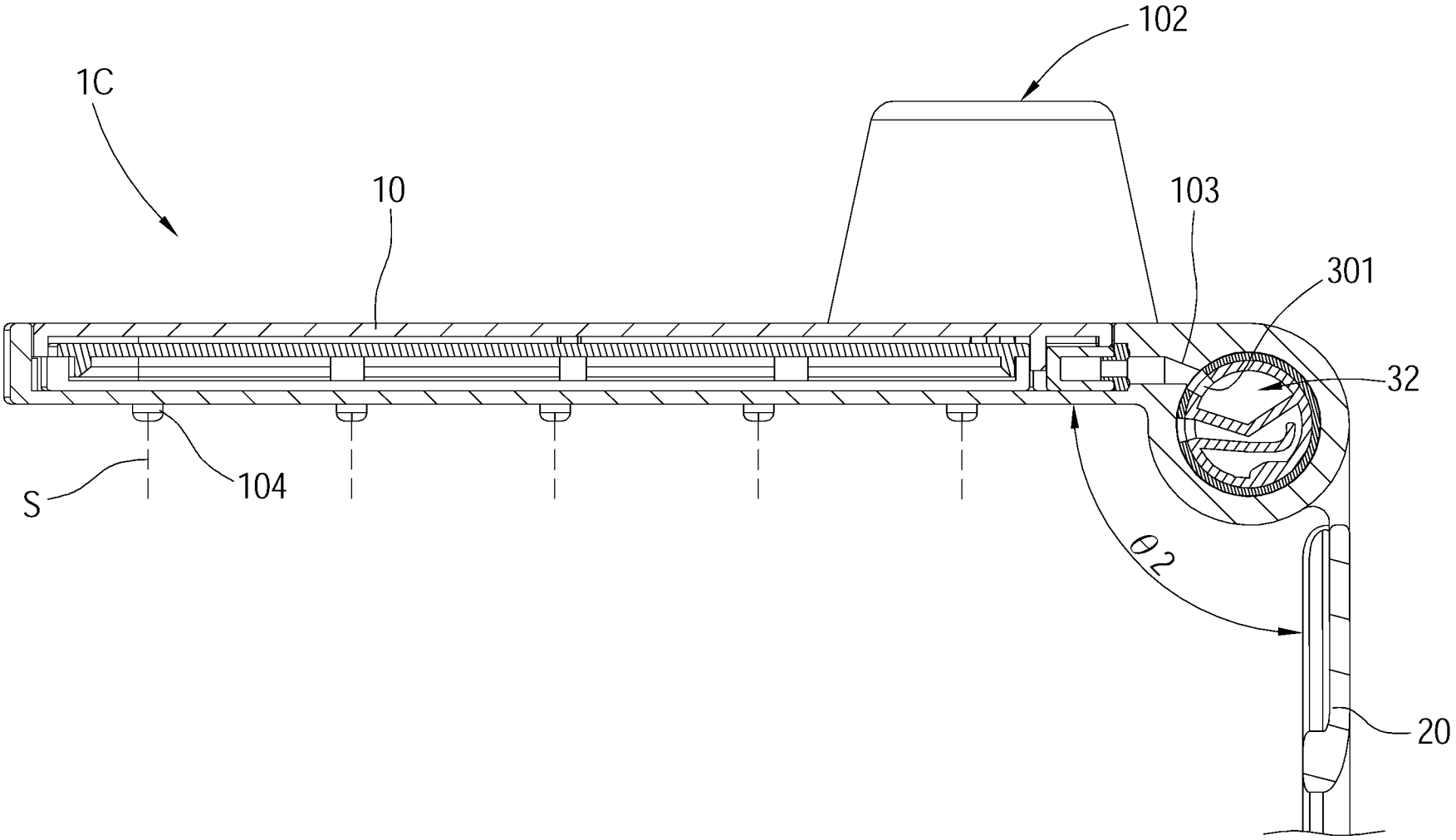
FIG. 8 is similar to FIG. 4, showing a sectional view of the shower apparatus of the first embodiment according to the present invention, wherein the shower apparatus is in the second output state.
Figure 9:
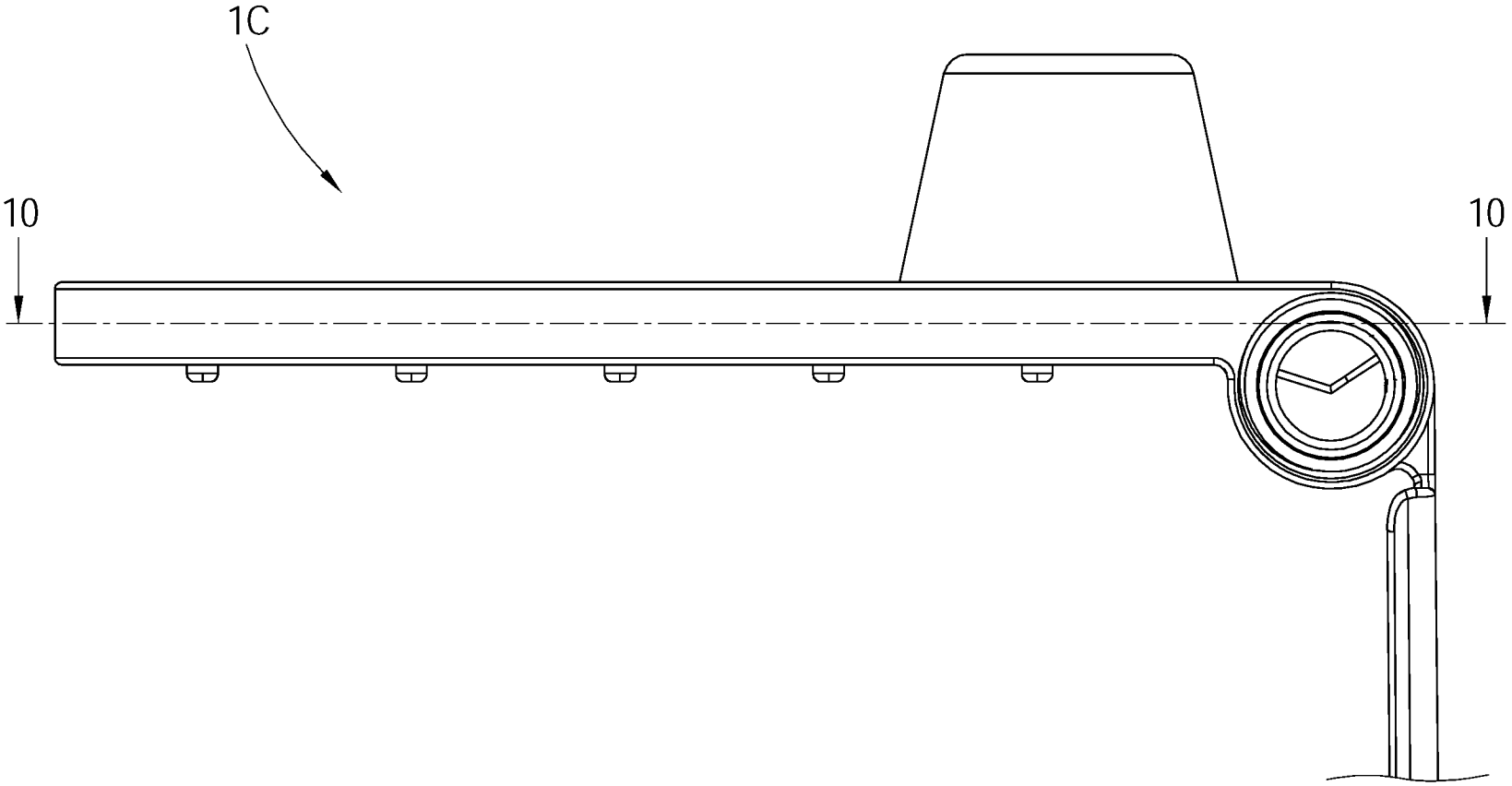
FIG. 9 is a side view of the shower apparatus of the first embodiment according to the present invention, wherein the shower apparatus is in the second output state.
Figure 10:
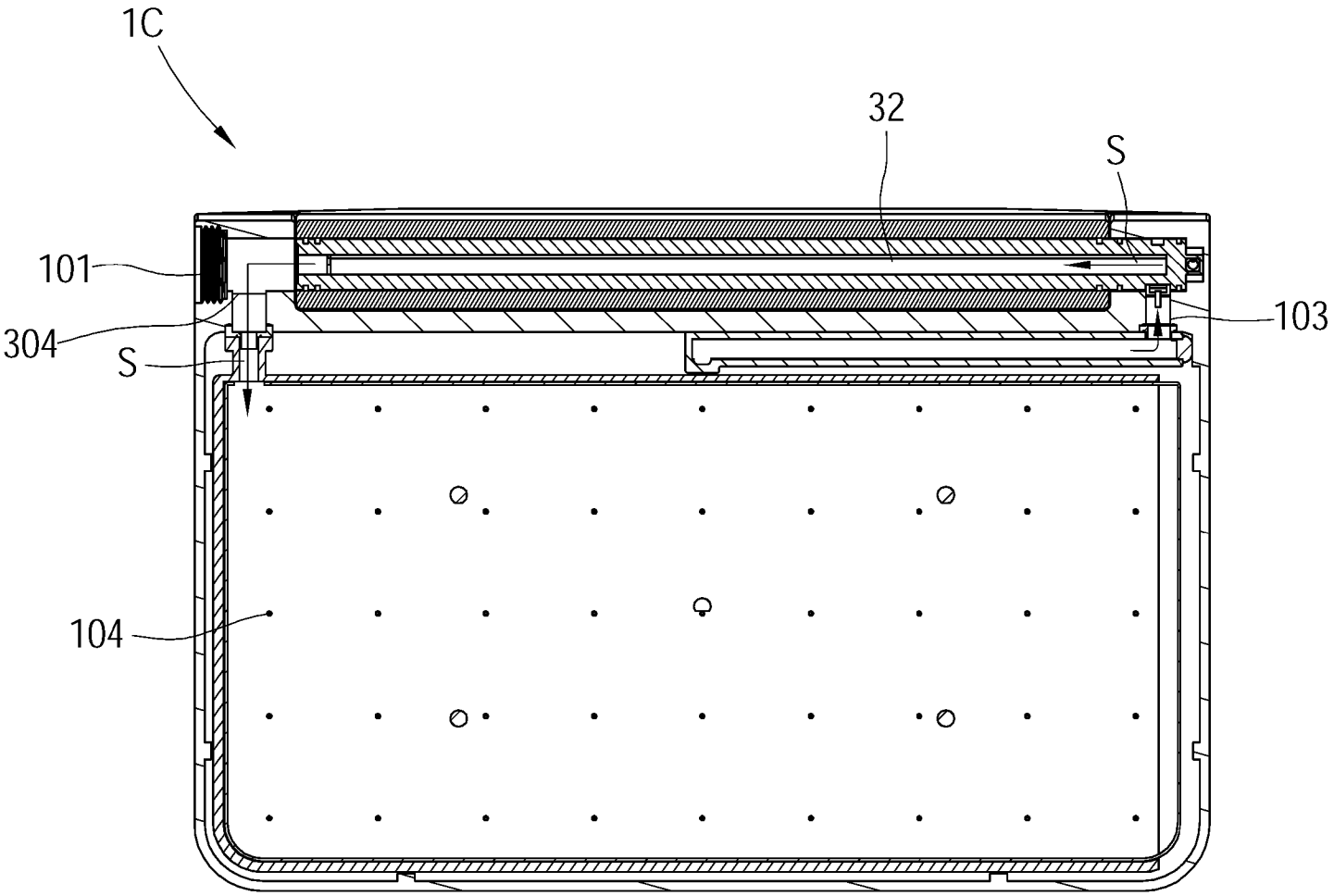
FIG. 10 is a sectional view taken along the 10-10 line in FIG. 9.
Figure 11:
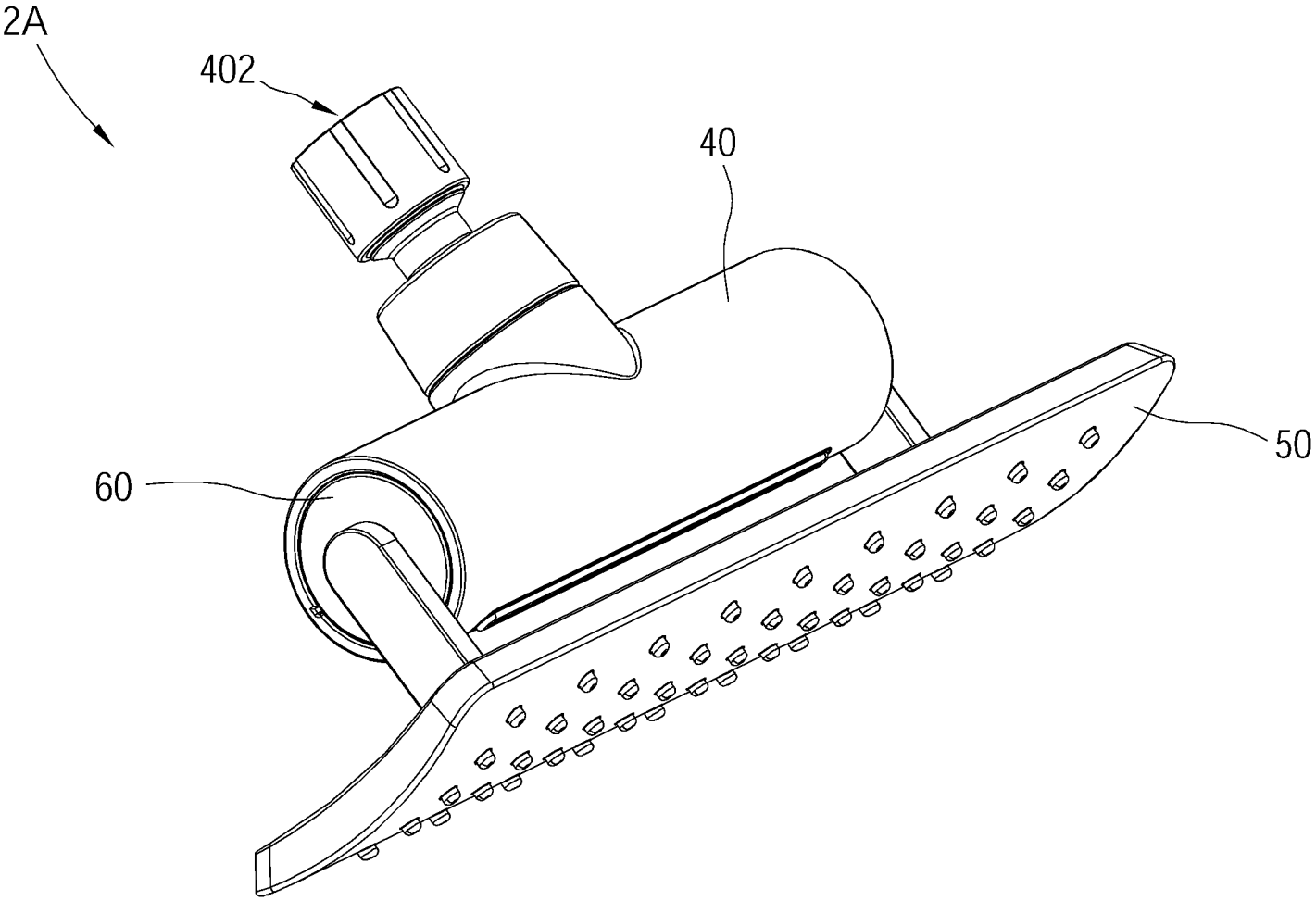
FIG. 11 is a perspective view of the shower apparatus of a second embodiment according to the present invention, wherein the shower apparatus is in the first output state.

As illustrated in FIG. 1 to FIG. 10, a shower apparatus 1A, 1B, 1C of a first embodiment according to the present invention includes a main body 10 and a pivotable member 20. As illustrated in FIG. 1 to FIG. 4, the shower apparatus 1A of the first embodiment according to the present invention is in a shut-off state. As illustrated in FIG. 5 to FIG. 7, the shower apparatus 1B of the first embodiment according to the present invention is in a first output state. As illustrated in FIG. 8 to FIG. 10, the shower apparatus 1C of the first embodiment according to the present invention is in a second output state.

The main body 10 has a receiving space 101, an inlet 102, and at least one first outlet 104, wherein the receiving space 101 communicates with the inlet 102. The main body 10 has a first communicating hole 103 which is located at a connection site between the receiving space 101 and the inlet 102.

The pivotable member 20 is pivotally connected to the main body 10 and is adapted to be operated to pivot relative to the main body 10. The pivotable member 20 includes a pivotal axle 30 and at least one second outlet 303, wherein the pivotal axle 30 is disposed in the receiving space 101.

When the pivotable member 20 is manipulated to pivot relative to the main body 10, the pivotal axle 30 is simultaneously pivoted in the same direction in the receiving space 101. The pivotal axle 30 has a tube body 31, an isolating member 34, a second communicating hole 301, and a third communicating hole 302, wherein the isolating member 34 is fixed in the tube body 31 to divide an inner space of the tube body 31 separately into a first flow channel 32 and a second flow channel 33. The second communicating hole 301 communicates with the at least one first outlet 104 via the first flow channel 32. The third communicating hole 302 communicates with the at least one second outlet 303 via the second flow channel 33.

As illustrated in FIG. 5 to FIG. 7, when the pivotable member 20 is manipulated to pivot relative to the main body 10 to make the third communicating hole 302 of the pivotal axle 30 communicate with the first communicating hole 103 of the main body 10, a stream F flowing through the third communicating hole 302 and the second flow channel 33 is outputted through the at least one second outlet 303. As illustrated in FIG. 8 to FIG. 10, when the pivotable member 20 is manipulated to pivot relative to the main body 10 to make the second communicating hole 301 of the pivotal axle 30 communicate with the first communicating hole 103 of the main body 10, a stream S flowing through the second communicating hole 301 and the first flow channel 32 is outputted through the at least one first outlet 104.

In the first embodiment, as illustrated in FIG. 1 to FIG. 4, when the pivotable member 20 is manipulated to pivot relative to the main body 10 and neither the second communicating hole 301 nor the third communicating hole 302 of the pivotal axle 30 communicates with the first communicating hole 103 of the main body 10, the shower apparatus 1A stops outputting.

As illustrated in FIG. 5 to FIG. 7, the at least one second outlet 303 is a slot. When the pivotable member 20 is operated to pivot relative to the main body 10 to a first position, the third communicating hole 302 of the pivotal axle 30 communicates with the first communicating hole 103 of the main body 10, the stream F is outputted through the slot to create a waterfall-like stream. When the stream F is outputted through the at least one second outlet 303, the stream F is unable to be outputted through the at least one first outlet 104.

In the first embodiment, the pivotable member 20 has a deflector, wherein the deflector is adapted to receive and to guide the waterfall-like stream. When the pivotable member 20 is located at the first position, a first angle θ1 is formed between the deflector of the pivotable member 20 and the main body 10.

In the first embodiment, the pivotal axle 30 has a flow retarding member 35 which is fixed in the tube body 31 and is located in the second flow channel 33. When the stream F flows through the second flow channel 33 and out of the at least one second outlet 303, the flow retarding member 35 could slow down a flow rate of the stream F.

As illustrated in FIG. 8 to FIG. 10, the at least one first outlet 104 includes a plurality of nozzles. When the pivotable member 20 is manipulated to pivot relative to the main body 10 to a second position, the second communicating hole 301 of the pivotal axle 30 communicates with the first communicating hole 103 of the main body 10, thereby the stream S flows out of the plurality of nozzle 104 to form a spray stream. When the pivotable member 20 is manipulated to pivot relative to the main body 10 to the second position, the stream S flowing out of the second communicating hole 301 of the pivotal axle 30 flows through the first flow channel 32 along an axial direction of the tube body 31 and then outputs through the at least one first outlet 104. When the stream S is outputted through the at least one first outlet 104, the stream S is unable to be outputted through the at least one second outlet 303.

In the first embodiment, the pivotal axle 30 has a fourth communicating hole 304 which communicates with the at least one first outlet 104. The second communicating hole 301 is located at an end of the first flow channel 32, and the fourth communicating hole 304 is located at another end of the first flow channel 32. The stream S flowing out of the second communicating hole 301 flows through the first flow channel 32 in the axial direction of the tube body 31 and then flows through the fourth communicating hole 304 and the at least one first outlet 104.

In the first embodiment, when the pivotable member 20 is located at the second position, a second angle θ2 is formed between the deflector of the pivotable member 20 and the main body 10, wherein the second angle θ2 is greater than the first angle θ2.

As illustrated in FIG. 11 to FIG. 19, a shower apparatus 2A, 2B of a second embodiment according to the present invention includes a main body 40 and a pivotable member 50.

Figure 14:
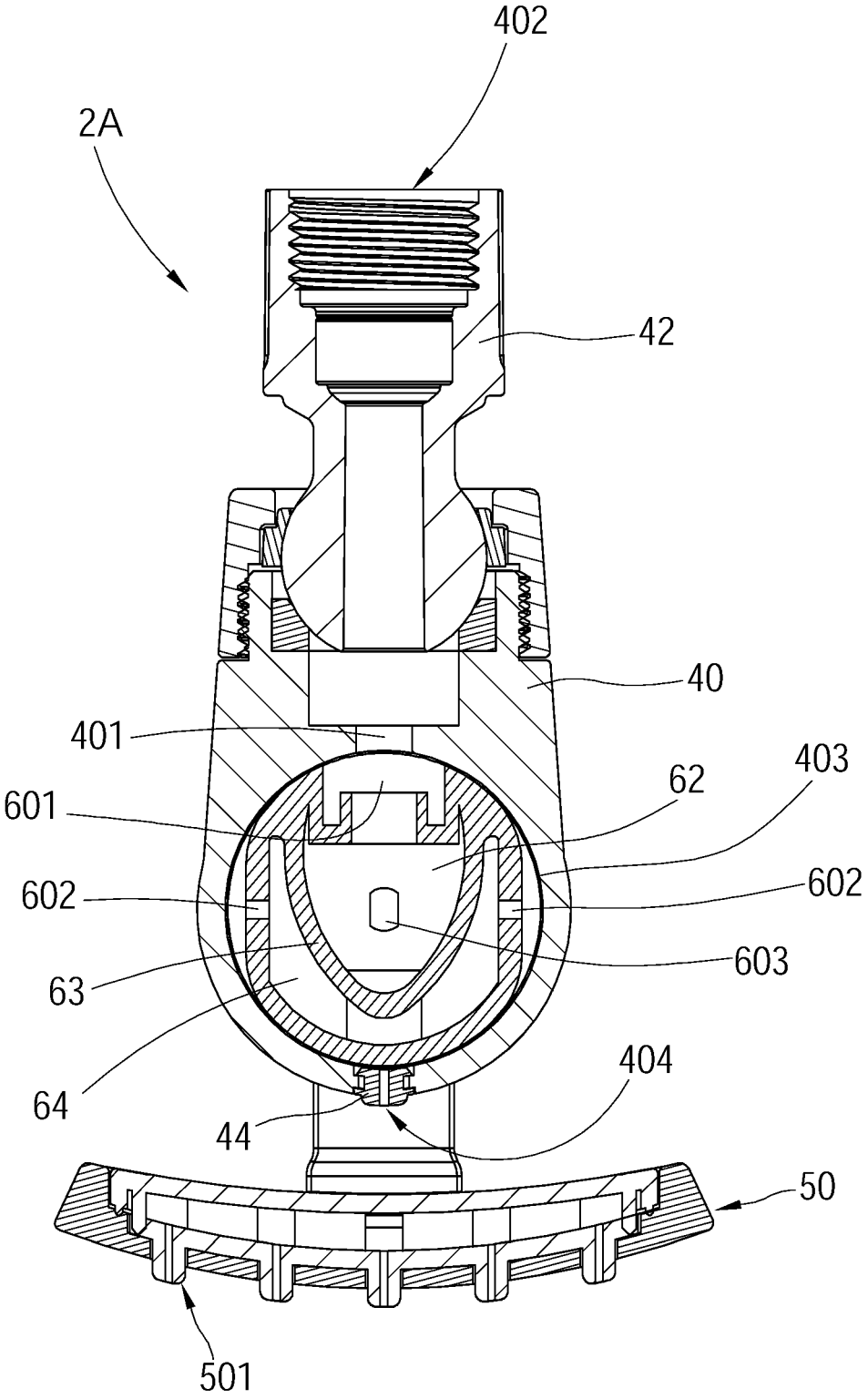
FIG. 14 is a sectional view taken along the 14-14 line in FIG. 13.
Figure 15:
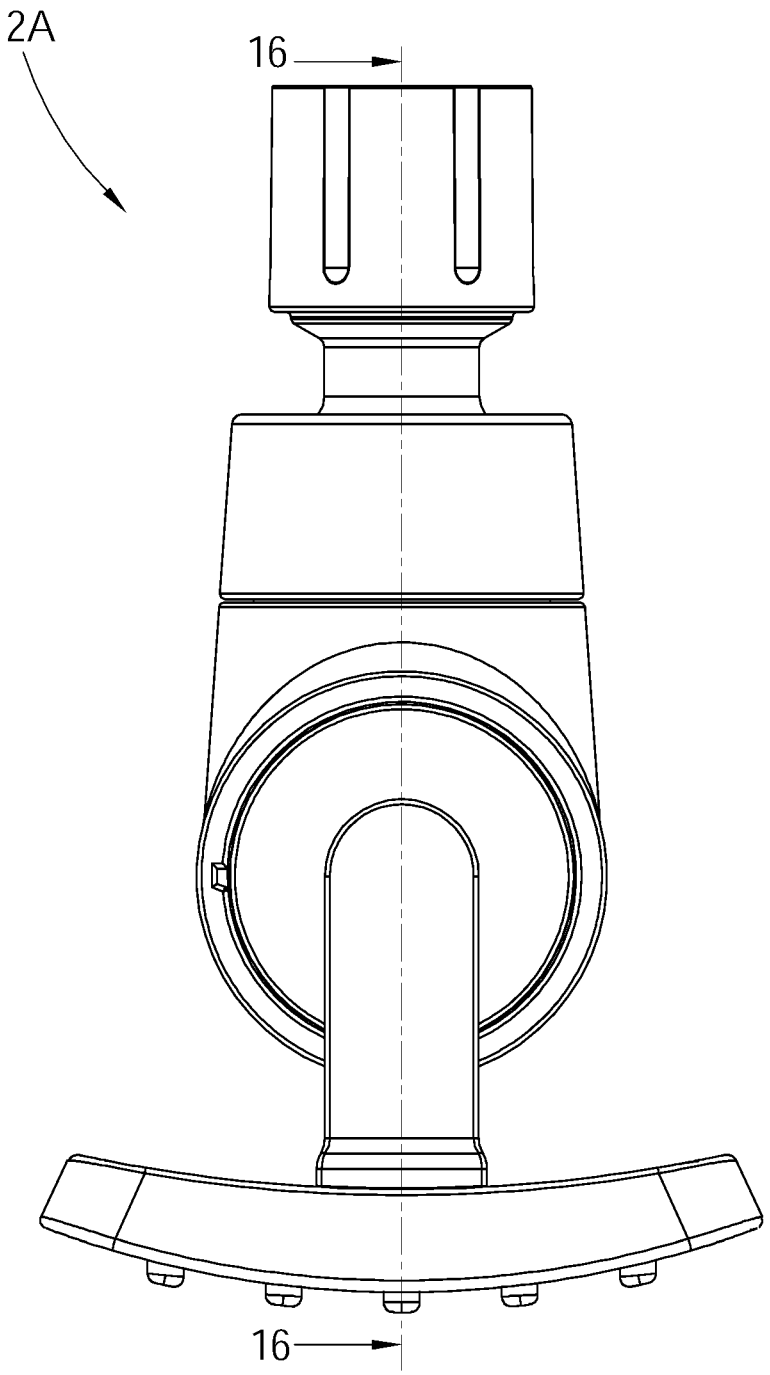
FIG. 15 is a side view of the shower apparatus shown in FIG. 11 from another perspective.
Figure 16:
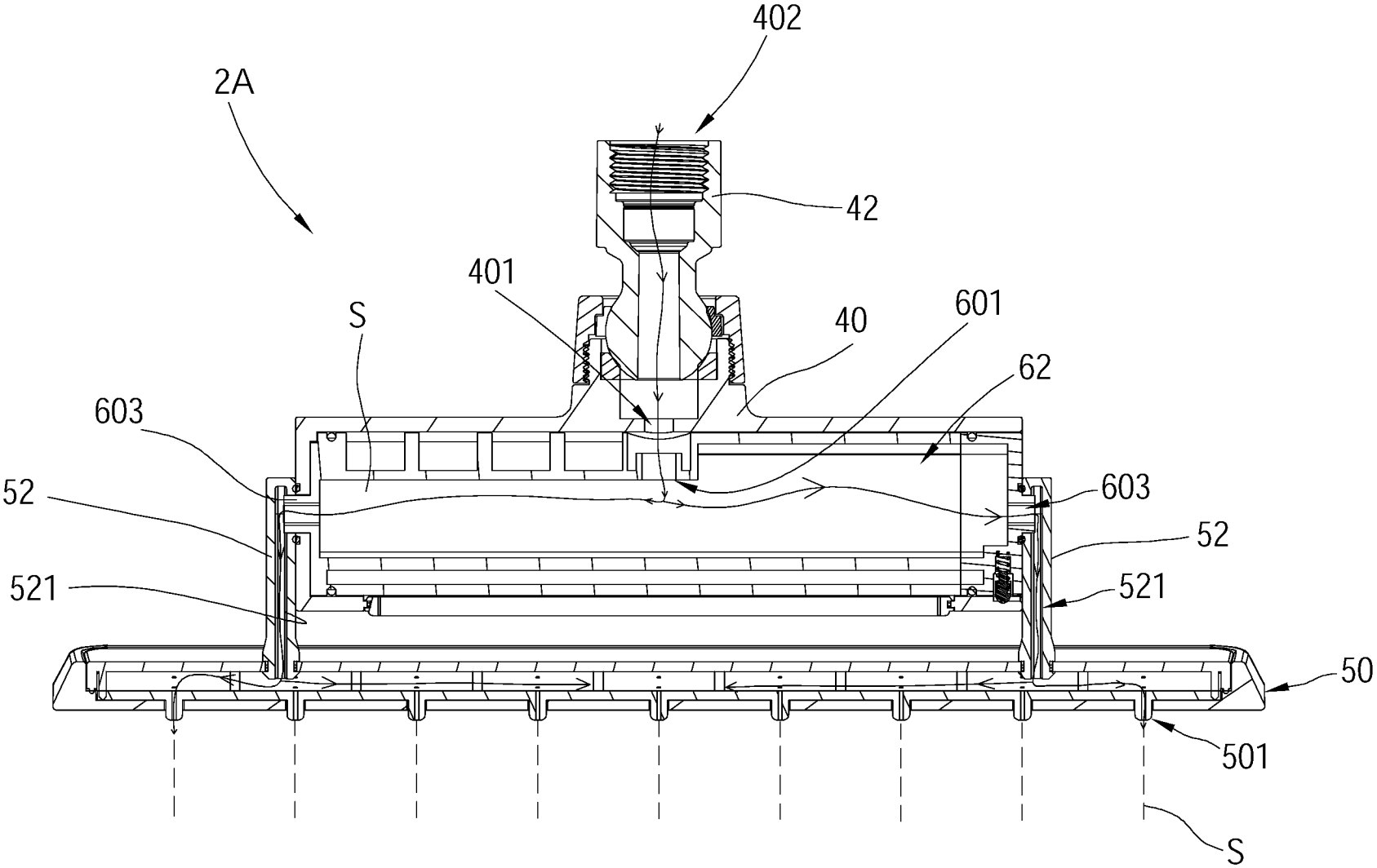
FIG. 16 is a sectional view taken along the 16-16 line in FIG. 15.
Figure 17:
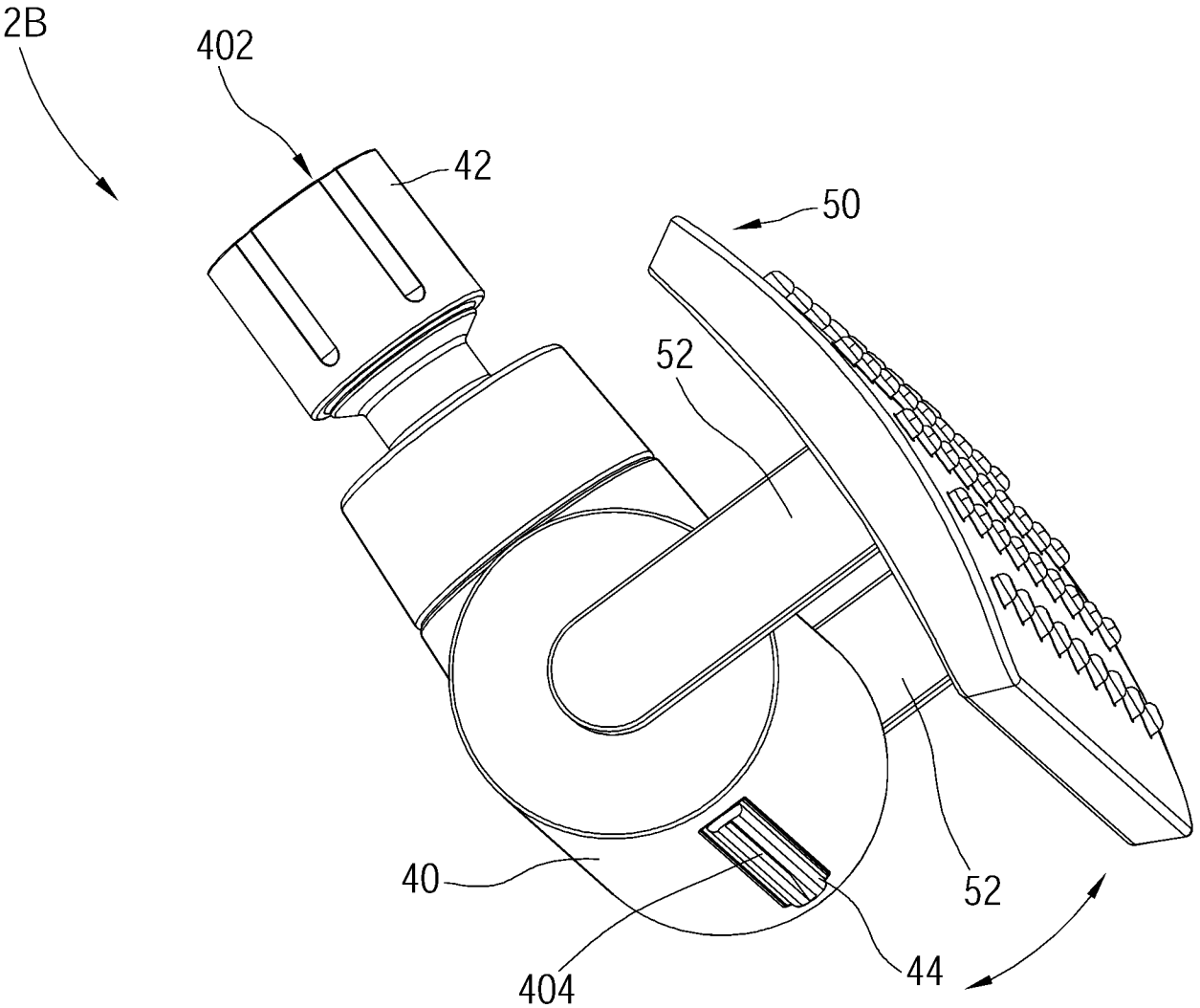
FIG. 17 is a perspective view of the shower apparatus of the second embodiment according to the present invention, wherein the shower apparatus is in the second output state.
Figure 18:
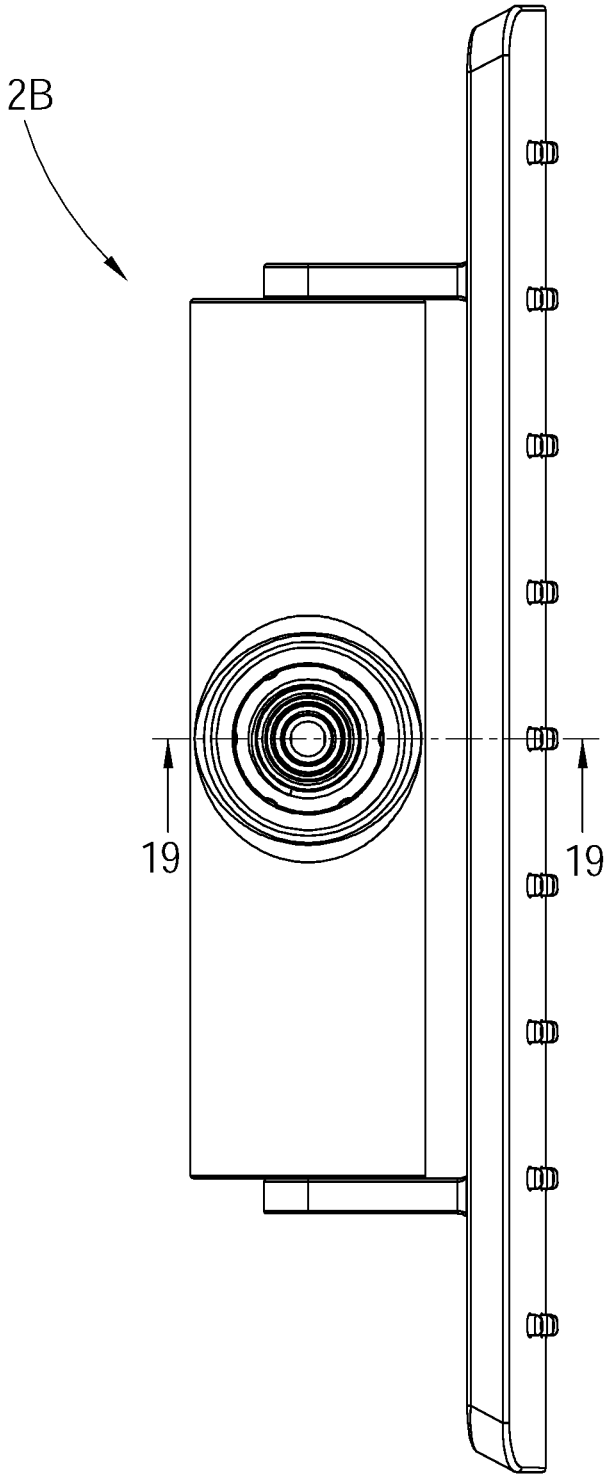
FIG. 18 is a top view of the shower apparatus shown in FIG. 17.
Figure 19:
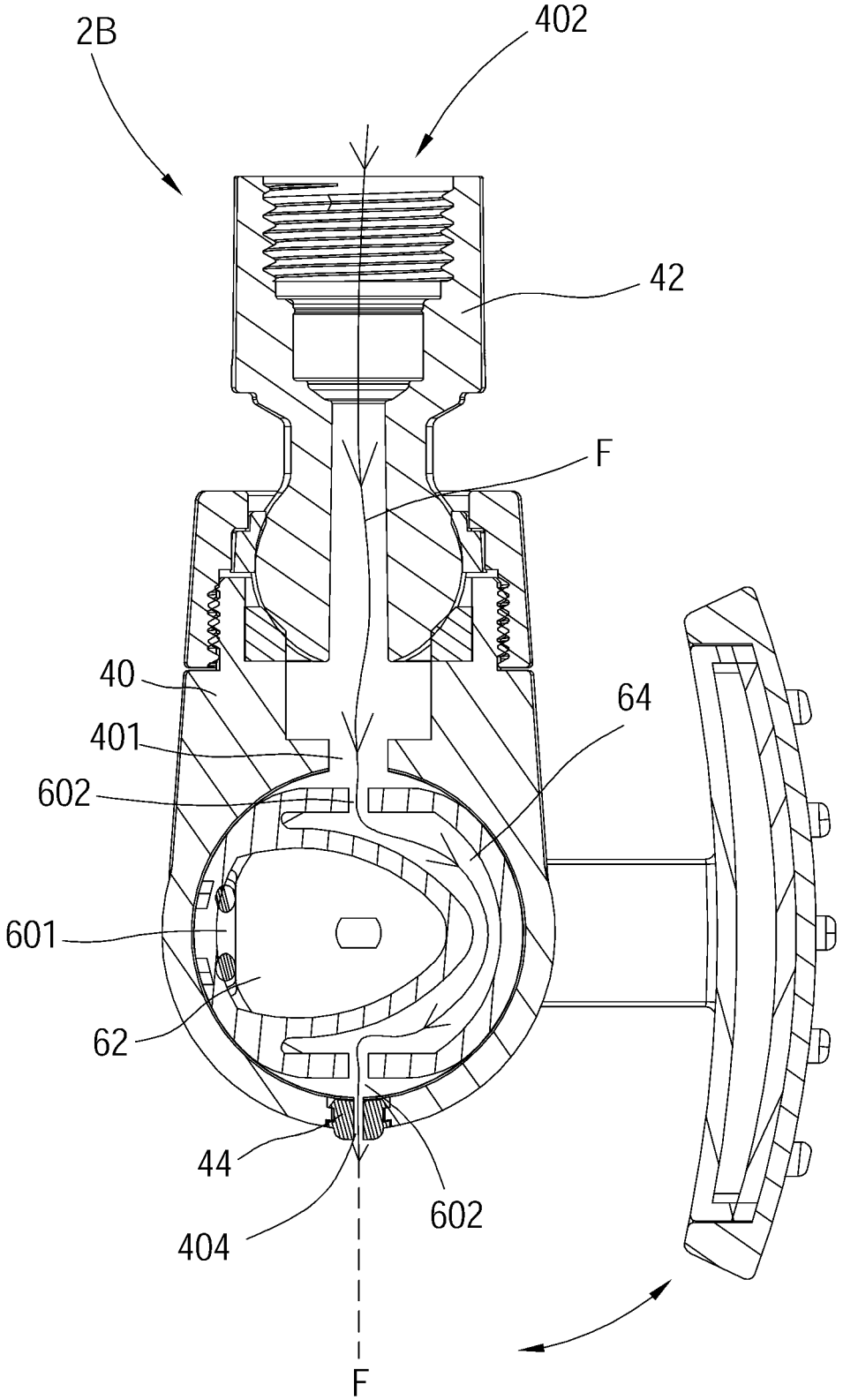
FIG. 19 is a sectional view taken along the 19-19 line in FIG. 18.

As illustrated in FIG. 14 and FIG. 19, the main body 40 has a receiving space 403, an inlet 402, and at least one first outlet 404, wherein the receiving space 403 communicates with the inlet 402, and the main body 40 has a first communicating hole 401 located at a connection site between the receiving space 403 and the inlet 402. In the second embodiment, the shower apparatus 2A, 2B further includes a universal joint 42. As illustrated in FIG. 13 to FIG. 16, the shower apparatus 2A of the second embodiment according to the present invention is in a first output state. As illustrated in FIG. 17 to FIG. 19, the shower apparatus 2B of the second embodiment according to the present invention is in a second output state.

The pivotable member 50 is pivotally connected to the main body 40 and is adapted to be operated to pivot relative to the main body 40. The pivotable member 50 includes a pivotal axle 60 and at least one second outlet 501, wherein the pivotal axle 60 is disposed in the receiving space 403 of the main body 40. When the pivotable member 50 is manipulated to pivot relative to the main body 40, the pivotal axle 60 is simultaneously pivoted in the same direction in the receiving space 403. The pivotal axle 60 has a tube body 61, an isolating member 63, at least one second communicating hole, and a third communicating hole 601, wherein the isolating member 63 is fixed in the tube body 61 to divide an inner space of the tube body 61 separately into a first flow channel 64 and a second flow channel 62. In the current embodiment, the at least one second communicating hole includes two second communicating holes 602. The two second communicating holes 602 communicate with the at least one first outlet 404 via the first flow channel 64; the third communicating hole 601 communicates with the at least one second outlet 501 via the second flow channel 62.

As illustrated in FIG. 17 to FIG. 19, when the pivotable member 50 is manipulated to pivot relative to the main body 40 to make the two second communicating holes 602 of the pivotal axle 60 communicate with the first communicating hole 401 of the main body 40, a stream F flows through the first flow channel 64 and is outputted through the at least one first outlet 404. As illustrated in FIG. 13 to FIG. 16, when the pivotable member 50 is manipulated to pivot relative to the main body 40 to make the third communicating hole 601 of the pivotal axle 60 communicate with the first communicating hole 401 of the main body 40, a stream S flows through the second flow channel 62 and is outputted through the at least one second outlet 501.

As illustrated in FIG. 13 to FIG. 16, the at least one second outlet 501 includes a plurality of nozzles. When the pivotable member 50 is operated to pivot relative to the main body 40 to a second position, the third communicating hole 601 of the pivotal axle 60 communicates with the first communicating hole 401 of the main body 40, thereby the stream S outputting through the plurality of nozzles 501 to form a spray stream. When the pivotable member 50 is operated to pivot relative to the main body 40 to the second position, the stream S flowing through the third communicating hole 601 of the pivotal axle 60 flows through the second flow channel 62 in an axial direction of the tube body 61 and is outputted through the at least one second outlet 501. When the stream S is outputted through the at least one second outlet 501, the stream S is unable to be outputted through the at least one first outlet 404.

In the second embodiment, the pivotal axle 60 has two fourth communicating holes 603 which communicate with the at least one second outlet 501. Each of the two fourth communicating holes 603 is located at one of two ends of the second flow channel 62, and the third communicating hole 601 is located between the two fourth communicating holes 603. The stream S flowing through the third communicating hole 601 of the pivotal axle 60 flows through the second flow channel 62 and the two fourth communicating holes 603 along an axial direction of the tube body 61 and then is outputted through the at least one second outlet 501.

Figure 12:
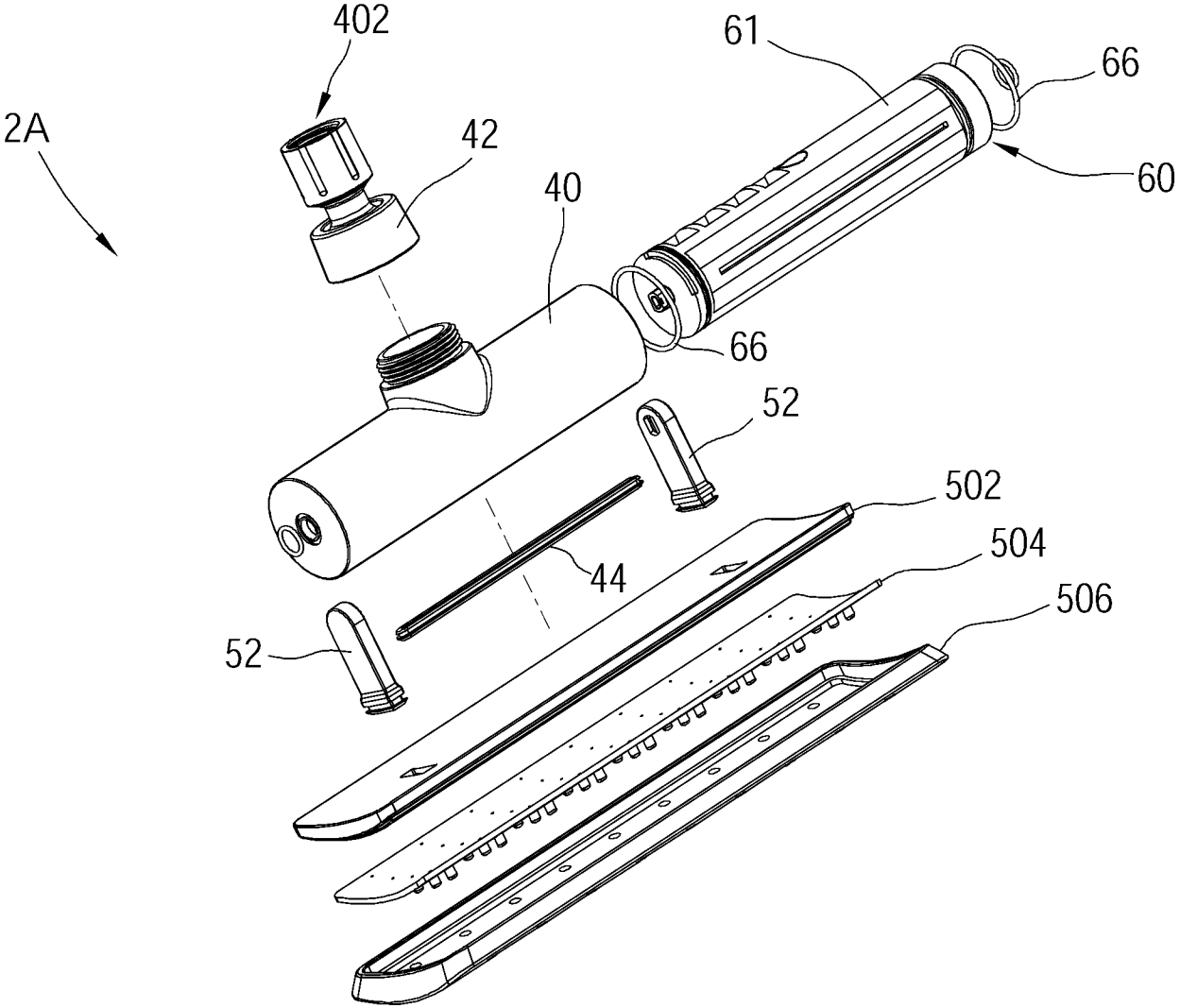
FIG. 12 is an exploded view of the shower apparatus of the second embodiment according to the present invention.
Figure 13:
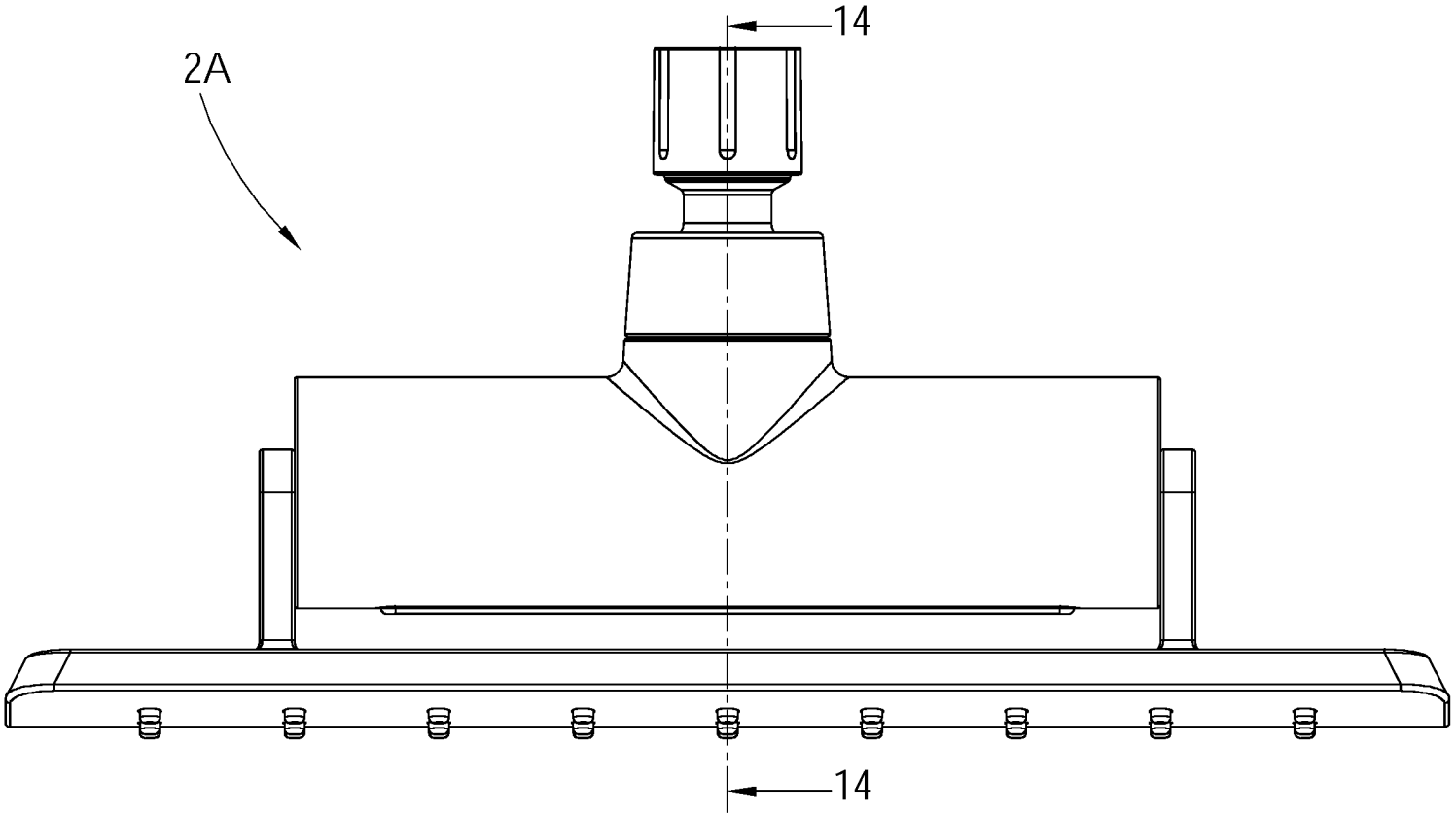
FIG. 13 is a side view of the shower apparatus shown in FIG. 11.

As illustrated in FIG. 12, in the second embodiment, the pivotable member 50 includes two connecting arms 52 and an outputting plate. Each of the two connecting arms 52 are pivotally connected to one of two ends of the main body 40 and communicate with the two fourth communicating holes 603 of the pivotal axle 60. The outputting plate includes a bottom plate 502, a nozzle plate 504, and a porous cover 506 which are stacked to be assembled, wherein the nozzle plate 504 includes the plurality of nozzles. The outputting plate is connected to and communicates with the two connecting arms 52 to allow the stream S which flowing through the two fourth communicating holes 603 of the pivotal axle 60 to flow through a communicating channel 521 of each of the two connecting arms 52 and to be outputted through the plurality of nozzles of the outputting plate.

As illustrated in FIG. 17 to FIG. 19, the at least one first outlet 404 is a slot. When the pivotable member 50 is operated to pivot relative to the main body 40 to a first position, the two second communicating holes 602 of the pivotal axle 60 communicates with the first communicating hole 401 of the main body 40, thereby the stream F is outputted through the slot to form a fall-like stream. When the stream F is outputted through the at least one first outlet 404, the stream F is unable to be outputted through the at least one second outlet 501.

In the second embodiment, the main body 40 has a slot ring 44, the slot ring 44 is disposed in the slot and is adapted to form the fall-like stream. Additionally, as illustrated in FIG. 12, the pivotal axle 60 includes two sealing rings 66 which respectively fit around two ends of the tube body 61 and are located between the tube body 61 and the main body 40, thereby avoiding water leaks between the pivotal axle 60 and the main body 40.

With the aforementioned design, the user could adjust the pivotal position (namely the first position and the second position described above) of the pivotable member on the required demand to make either the second communicating hole of the third communicating hole of the pivotal axle communicates with the first communicating hole of the main body, so that the stream could flow through either the first flow channel or the second flow channel and be outputted through corresponding one of the first outlet and the second outlet, thereby providing a various outputting efficacy to improve the fun during showering and to satisfy the showering demand of the user.

It must be pointed out that the embodiments described above are only preferred embodiments of the present invention. All equivalent structures which employ the concepts disclosed in this specification and the appended claims should fall within the scope of the present invention.

What is claimed is:

1. A shower apparatus, comprising:

a main body having a receiving space, an inlet, and at least one first outlet, wherein the receiving space communicates with the inlet, and the main body has a first communicating hole located at a connection site between the receiving space and the inlet;

a pivotable member pivotally connected to the main body and adapted to be operated to pivot relative to the main body, wherein the pivotable member comprises a pivotal axle and at least one second outlet, wherein the pivotal axle is disposed in the receiving space; when the pivotable member is manipulated to pivot relative to the main body, the pivotal axle is simultaneously pivoted in a same direction in the receiving space; the pivotal axle has a tube body, an isolating member, a second communicating hole, and a third communicating hole, wherein the isolating member is fixed in the tube body to divide an inner space of the tube body to separately form a first flow channel and a second flow channel; the second communicating hole communicates with the at least one first outlet via the first flow channel; the third communicating hole communicates with the at least one second outlet via the second flow channel;

wherein when the pivotable member is manipulated to pivot relative to the main body to make the second communicating hole of the pivotal axle communicate with the first communicating hole of the main body, a stream flowing through the second communicating hole and the first flow channel is outputted through the at least one first outlet; when the pivotable member is manipulated to pivot relative to the main body to make the third communicating hole of the pivotal axle communicate with the first communicating hole of the main body, a stream flowing through the third communicating hole and the second flow channel is outputted through the at least one second outlet.

2. The shower apparatus of claim 1, wherein when the pivotable member is manipulated to pivot relative to the main body to make neither the second communicating hole nor the third communicating hole of the pivotal axle communicate with the first communicating hole of the main body, the shower apparatus stops outputting.

3. The shower apparatus of claim 1, wherein the at least one second outlet is a slot; when the pivotable member is manipulated to pivot relative to the main body to a first position, the third communicating hole of the pivotal axle communicates with the first communicating hole of the main body, and the stream flowing through the third communicating hole is outputted through the slot to create a waterfall-like stream.

4. The shower apparatus of claim 3, wherein the pivotable member has a deflector adapted to receive and to guide the waterfall-like stream; when the pivotable member is located at the first position, a first angle is formed between the deflector of the pivotable member and the main body.

5. The shower apparatus of claim 1, wherein the at least one first outlet comprises a plurality of nozzles; when the pivotable member is manipulated to pivot relative to the main body to a second position, the second communicating hole of the pivotal axle communicates with the first communicating hole of the main body, thereby the stream flowing through the second communicating hole flows out of the plurality of nozzles to form a spray stream.

6. The shower apparatus of claim 4, wherein the at least one first outlet comprises a plurality of nozzles; when the pivotable member is manipulated to pivot relative to the main body to a second position, the second communicating hole of the pivotal axle communicates with the first communicating hole of the main body, thereby the stream flowing through the second communicating hole flows out of the plurality of nozzles to form a spray stream.

7. The shower apparatus of claim 1, wherein when the pivotable member is manipulated to pivot relative to the main body to a second position, the stream which flows out of the second communicating hole of the pivotal axle flows through the first flow channel along an axial direction of the tube body and then outputs through the at least one first outlet.

8. The shower apparatus of claim 2, wherein when the pivotable member is manipulated to pivot relative to the main body to a second position, the stream which flows out of the second communicating hole of the pivotal axle flows through the first flow channel along an axial direction of the tube body and then outputs through the at least one first outlet.

9. The shower apparatus of claim 7, wherein the pivotal axle has a fourth communicating hole which communicates with the at least one first outlet; the second communicating hole is located at an end of the first flow channel, and the fourth communicating hole is located at another end of the first flow channel; the stream which flows out of the second communicating hole flows through the first flow channel in the axial direction of the tube body and then flows through the fourth communicating hole and the at least one first outlet.

10. The shower apparatus of claim 8, wherein the pivotal axle has a fourth communicating hole which communicates with the at least one first outlet; the second communicating hole is located at an end of the first flow channel, and the fourth communicating hole is located at another end of the first flow channel; the stream which flows out of the second communicating hole flows through the first flow channel in the axial direction of the tube body and then flows through the fourth communicating hole and the at least one first outlet.

11. The shower apparatus of claim 7, wherein the pivotal axle has two fourth communicating holes which communicate with the at least one second outlet; each of the two fourth communicating holes is located at one of two ends of the second flow channel, and the third communicating hole is located between the two fourth communicating holes; the stream which flows through the third communicating hole of the pivotal axle flows through the second flow channel and the two fourth communicating holes along the axial direction of the tube body and then is outputted through the at least one second outlet.

12. The shower apparatus of claim 8, wherein the pivotal axle has two fourth communicating holes which communicate with the at least one second outlet; each of the two fourth communicating holes is located at one of two ends of the second flow channel, and the third communicating hole is located between the two fourth communicating holes; the stream which flows through the third communicating hole of the pivotal axle flows through the second flow channel and the two fourth communicating holes along the axial direction of the tube body and then is outputted through the at least one second outlet.

13. The shower apparatus of claim 6, wherein when the pivotable member is located at the second position, a second angle is formed between the deflector of the pivotable member and the main body, and the second angle is greater than the first angle.

14. The shower apparatus of claim 1, wherein the pivotal axle has a flow retarding member which is fixed in the tube body and is located in the second flow channel; when the stream flows through the second flow channel and flows out of the at least one second outlet, the flow retarding member slows down a flow rate of the stream.

* * * * *